US007819721B1

(12) United States Patent
Messier

(10) Patent No.: US 7,819,721 B1
(45) Date of Patent: Oct. 26, 2010

(54) INTERCHANGEABLE DECORATIVE ACCESSORIES FOR PERSONAL ADORNMENT

(76) Inventor: Charlotte F. Messier, 89 N. Triangle Dr., Plymouth, MA (US) 02360

( * ) Notice: Subject to any disclaimer, the term of this patent is extended or adjusted under 35 U.S.C. 154(b) by 183 days.

(21) Appl. No.: 11/965,364

(22) Filed: Dec. 27, 2007

Related U.S. Application Data

(60) Provisional application No. 60/882,099, filed on Dec. 27, 2006.

(51) Int. Cl.
*A41C 3/00* (2006.01)

(52) U.S. Cl. ..... 450/86; 2/244; 2/246; 36/8.3

(58) Field of Classification Search ..... 2/338, 2/336, 326, 310–312, 67, 69, 1, 246, 244; 450/86, 88, 1; 36/8.3, 9 R, 10; 63/2, DIG. 1
See application file for complete search history.

(56) References Cited

U.S. PATENT DOCUMENTS

| | | | | |
|---|---|---|---|---|
| 136,649 | A * | 3/1873 | Goldthwait | 36/58.5 |
| 3,956,804 | A * | 5/1976 | Gatof et al. | 24/598.5 |
| 5,279,132 | A * | 1/1994 | Swaim | 63/3.1 |
| 5,386,710 | A | 2/1995 | Moore | |
| 6,086,451 | A * | 7/2000 | Fernandes | 450/86 |
| D432,760 | S | 10/2000 | Brachfeld | |
| 6,155,906 | A * | 12/2000 | May | 450/88 |
| 6,179,687 | B1 * | 1/2001 | Lee et al. | 450/88 |
| 6,517,409 | B2 * | 2/2003 | Flaherty | 450/1 |
| 6,656,013 | B1 * | 12/2003 | Wang | 450/86 |
| 6,715,186 | B1 | 4/2004 | Huang | |
| D519,261 | S | 4/2006 | Reis | |
| 7,396,273 | B2 * | 7/2008 | Styles-Gaviria et al. | 450/86 |
| 7,513,816 | B1 * | 4/2009 | McCullough et al. | 450/86 |
| 2006/0005576 | A1 | 1/2006 | Detsis | |

* cited by examiner

*Primary Examiner*—Gloria Hale
(74) *Attorney, Agent, or Firm*—Knobbe Martens Olson & Bear, LLP

(57) ABSTRACT

A decorative accessory for adorning a wearer's person, such as the arch area of the foot, and can also be interchangeably secured to a variety of different articles of clothing, accessories, or areas of the wearer's body. The decorative accessory includes an elongate strap, adjustment devices for adjustable expansion and contraction, and attachment devices for securing the decorative accessory to a variety of locations. The decorative accessory also has a fastening mechanism for removably attaching a variety of different decorative components such as charms, rings, and other jewelry to the decorative accessory.

9 Claims, 12 Drawing Sheets

INTERCHANGEABLE DECORATIVE ACCESSORIES FOR PERSONAL ADORNMENT

RELATED APPLICATIONS

This application claims the benefit of priority under 35 U.S.C. §119(e) of U.S. Provisional Application No. 60/882,099 filed on Dec. 27, 2006 and entitled INTERCHANGEABLE DECORATIVE ACCESSORIES FOR PERSONAL ADORNMENT.

BACKGROUND OF THE INVENTION

1. Field of the Invention

The present invention relates generally to decorative accessories for adornment of a wearer's body, and more particularly, to decorative accessories that can be interchangeably worn on a variety of different articles of clothing and areas of a wearer's body.

2. Description of the Related Art

Decorative accessories such as bracelets, rings, anklets, necklaces etc., are generally designed to specifically adorn particular areas of the body. For example, it is generally difficult to place an anklet on another region of the body where the dimensions of the anklet cannot accommodate non-ankle-like proportions. Moreover, the length of necklaces and bracelets are generally limited to encircling the areas around the neck and wrist, respectively, without permitting the use of necklaces as bracelets and vice versa.

Consequently, the specificity of jewelry and decorative pieces for particular areas of the body can lead to a number of problems. One of such problems is the unintended accumulation of adornment clutter. Faced with the challenges of body-area specific decorations, individuals are often forced to acquire multiple and, at times, redundant accessories to accommodate different articles of clothing, accessories, or locations on a wearer's body. This accumulation can quickly result in an undesirable increase of clutter in one's home, office, or storage space.

Additionally, for many individuals, purchasing decorative accessories and jewelry is a necessary but costly endeavor. For these individuals, it is economical, practical, and aesthetically desirable to be able to wear an item of jewelry or accessory interchangeably on different articles of clothing and areas of the body at different times.

Hence, there is a need for a decorative accessory that can adorn a variety of areas on a wearer's body and articles of clothing. To this end, there is a particular need for a decorative accessory that permits a wearer to interchangeably wear the decorative accessory on a variety of different locations.

SUMMARY OF THE INVENTION

The preferred embodiments of the interchangeable decorative accessory of the present invention have several features, no single one of which is solely responsible for their desirable attributes. Without limiting the scope of this invention, its more prominent features will now be discussed briefly. However, not all of the following features are necessary to achieve the advantages of the accessory. Therefore, none of the following features should be viewed as limiting. After considering this discussion, and particularly after reading the section entitled "Detailed Description of the Preferred Embodiments," one will understand how the features of the preferred embodiments provide advantages over prior art accessory items.

In one aspect, the preferred embodiments of the present invention provide an interchangeable, decorative accessory. The accessory comprises an elongate member having a first end and a second end, wherein the elongate member is sized to extend annularly around the arch area of a person's foot. The accessory further comprises an adornment attachment member, which preferably extends outwardly from a surface of the elongate member. The accessory further comprises a plurality of fastening members, wherein one fastening member is disposed on the first end and another fastening member is disposed on the second end of the elongate member. The accessory further comprises an adornment, wherein the adornment is attached to the elongate member via the adornment attachment member in a manner such that when the elongate member extends annularly around the arch area of the person's foot, the adornment rests against at least a portion of the top of the person's foot. The accessory further comprises a length adjustment member, wherein the length adjustment member is adapted to adjust the length of the elongate member such that the elongate member can be used interchangeably between the arch area of a person's foot and an article of clothing. In one embodiment, the interchangeable, decorative accessory can be interchangeably worn as a foot jewelry and also as a decorative bra strap.

In another aspect, the preferred embodiments of the present invention provide a decorative accessory kit. The kit comprises a plurality of elastic straps, wherein each strap has an adornment attachment device and a plurality of fastening members. Preferably, each strap is sized to extend annularly around the arch area of a person's foot. Preferably, each elastic strap has two fastening members wherein each fastening member is adapted to mate with the other fastening member so as to attach the strap around the arch area of the person's foot. The two fastening members are also adapted to mate with an insertion loop present on bras so as to attach the elastic strap as part of a bra strap. The decorative kit further comprises a plurality of adornment members, wherein each adornment member is adapted to couple with the adornment attachment device on each of the elastic straps. Preferably, each of the plurality of elastic straps can be used interchangeably with the adornment members to adorn the arch area of the person's foot as well as articles of clothing.

In yet another aspect, the preferred embodiments of the present invention provide an interchangeable decorative accessory for adornment of a plurality of locations on a wearer's body. In one embodiment, the decorative accessory is sized to extend annularly around the arch area of a person's foot. The accessory further comprises a fastening system for removably securing the accessory to the arch area of the foot and an attachment device for removably attaching a decorative component such as a charm, ring, or other jewelry to the accessory. Preferably, the decorative component is coupled to the accessory in a manner such that the decorative component rests against an upper surface of the foot when the accessory is worn around the arch area of the foot. In one implementation, the decorative accessory is also adapted to replace a portion of a bra strap so as to embellish the bra strap. Preferably, the fastening system of the decorative accessory is configured to attach the accessory to the bra strap in a manner such that the accessory extends vertically between one end of the bra strap and the bra cup and the decorative component faces outwardly to embellish the bra strap. In yet another implementation, the decorative accessory can also be interchangeably used to adorn other articles of clothing, such as shoes, or other parts of a person's body.

Preferably, the accessory also includes a length adjustment element which provides for lengthening and shortening of the decorative accessory. In some embodiments, the length adjustment element may be an inherent property of the decorative accessory. For example, the decorative accessory can comprise an elastic or flexible strap that provides adjustable expansion or contraction. Additionally, the length adjustment element may be a discrete component such as an adjustment slide located along the length of the accessory that provides lengthening or shortening depending on the movement of the slide along the strap. In further embodiments, the length adjustment element may be a knot designed to provide adjustable sizing.

In another preferred embodiment, the fastening system of the accessory comprises a plurality of attachment members that are disposed adjacent to end portions of the accessory. In some embodiments, the attaching members are selected from the group consisting of insertion loops, "S" shape fasteners, hinge fasteners, hook and loop clasps, barrel clasps, spring clasps, lobster clasps, magnetic clasps, toggle clasps, box clasps, hook and pile material (such as that sold under the trademark "VELCRO"), and/or rings. In other embodiments, the attachment member can be either a female or male attaching point capable of attaching and detaching with a corresponding mating attaching point.

In another embodiment, the decorative accessory further comprises at least one interchangeable decorative component. Preferably, the decorative components are interchangeable, removable, and replaceable. In further embodiments, the decorative accessory is washable and cleanable.

In yet another aspect, the preferred embodiments of the present invention provide an interchangeable decorative accessory kit. The kit generally includes at least one elongate member, such as a strap, sized to extend annularly around the arch area of a person's foot. Preferably, a multi-purpose fastening mechanism is disposed on the elongate member and adapted to removably attach the elongate member to the person's foot and also to secure the elongate member to a bra strap or other articles of clothing. The kit further includes a plurality of decorative components that can be interchangeably coupled to the elongate member. In a preferred implementation, the decorative accessory kit is adapted to be used interchangeably to adorn the arch area of the foot and also to embellish a bra strap, a shoe and/or other articles of clothing. In another preferred implementation, the decorative accessory kit is adapted to provide an accessory with one or more components that can be interchangeably attached thereto.

In certain preferred embodiments, the decorative accessory may be removed from the arch area of the foot and secured to another article of clothing, accessory, or body area. In some embodiments, the article of clothing is a shoe comprising at least one attachment member designed to connect and secure the decorative accessory to the shoe for adornment. Preferably, the shoe or footwear has insertion loops positioned to allow the attaching member to enter and connect with the loops such that the decorative accessory is secured to the footwear. In some embodiments, the footwear comprises attachment members that can mate with and connect to the corresponding mating attachment members located on the decorative accessory.

In other preferred embodiments, the decorative accessory may be removed from the footwear and/or foot and worn elsewhere. In some embodiments, the decorative accessory adorns a clothing strap such as a bra strap or camisole strap. In preferred embodiments, the clothing strap comprises attachment elements such as insertion loops to accommodate the attaching members located on the decorative accessory. In other embodiments, the decorative accessory attaches to more than one separable segment of clothing such that when attached, the decorative accessory secures the separable segments together. In further embodiments, the decorative accessory may interchangeably adorn and attach to another accessory such as a necklace or belt.

DETAILED DESCRIPTION OF THE PREFERRED EMBODIMENT

Figure 1A:
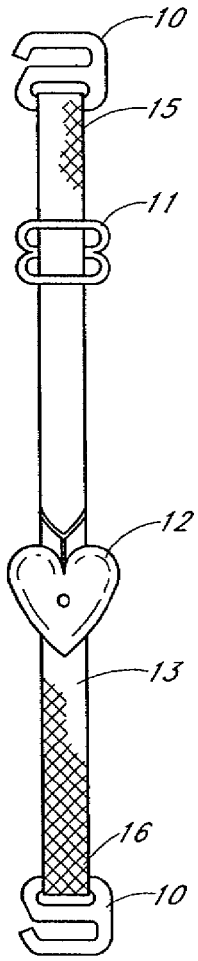
FIG. 1A-1C are each a schematic illustration of an interchangeable decorative accessory of one preferred embodiment of the present invention.

Reference will now be made to the drawings wherein like numerals refer to like parts throughout. FIG. 1A provides a schematic illustration of an interchangeable decorative accessory of one preferred embodiment for the present invention. As shown in FIG. 1A, the decorative accessory generally comprises an elongate body 13 having a first end 15 and second end 16, an adjustment means 11 adapted to shorten or lengthen the elongate body, and at least two attaching means 10 positioned respectively at the first end 15 and at the second end 16 of the elongate body 13. The adjustment means and the attaching means are adapted to interchangeably secure the decorative accessory to a variety of different articles of clothing, accessories, or areas of a wearer's body to be described in greater detail below.

As illustrated in FIG. 1A, the elongate body 13 comprises a strap having a length that is greater than its width. Preferably, the strap 13 is made from materials suitable for contact with clothing, accessories, or a wearer's body. These materials can include, for example, lightweight, flexible, and stretchable material such as elastomeric materials, polymeric materials, fabric, and/or hemp. Additionally, the strap may be formed from lanyards, cords, gems, beads, pearls, ribbons, chains, string, and yarn. In some preferred embodiments, the strap is made from a transparent or see-through material to substantially minimize the visibility of the strap when worn. Yet, in other embodiments, the straps themselves can assume a variety of different colors and textures to further add to the aesthetics of the accessory. Preferably, the strap has a minimum thickness such that when worn, the wearer perceives the elongate strap to be planar or flat against the surface the decorative accessory is worn against. In one embodiment, the length of the strap is preferably 9 inches, more preferably 12 inches.

As further shown in FIG. 1A, the adjustment means may comprise an adjustment slide 11 positioned on the elongate strap, such that translational movement by the slide along the length of the strap provides more or less length as needed. In further embodiments, the adjustment means can be a knot formed from the material of the strap itself or otherwise, which allows dimensional adjustment by manipulating the knot on the strap. The knot may be, for example, a macramé knot designed to provide adjustable expansion and contraction for the decorative accessory. In certain other embodiments, the adjustment means may be an elastic material forming the strap such that the strap may stretch, contract, and flex to accommodate a variety of sizes. The adjustment means may As shown in FIG. 1A, the decorative accessory further comprises one or more decorative components 12 secured to the elongate body 13. Some decorative components include, for example, ribbons, bows, beads, gems, pearls, metals, jewelry, or charms. These decorative components may be interchangeable, removable, and replaceable such that the wearer has creative license to select the components on the decorative accessory. In preferred embodiments, the decorative components are interchangeable, removable, and replaceable by detaching the decorative component from the elongate body and either attaching a different component to the elongate body or securing the just detached component to an elongate body of another decorative accessory. Preferably, the decorative components may be removably secured to the decorative accessory via attaching means such as, for example, jump rings, clasps, hooks, "S" shape fasteners, hinge fasteners, hook and loop clasps, barrel clasps, spring clasps, lobster clasps, magnetic clasps, toggle clasps, box clasps, hook and pile material (such as that sold under the trademark "VELCRO"), and/or rings.

Figure 1B:
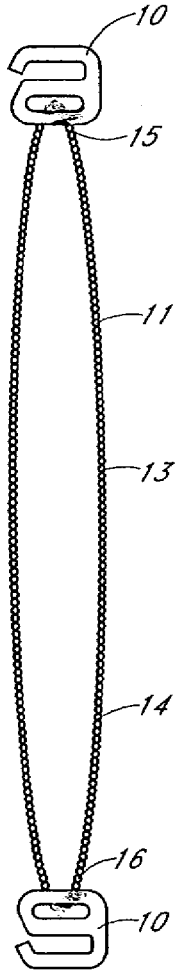
Figure 1C:
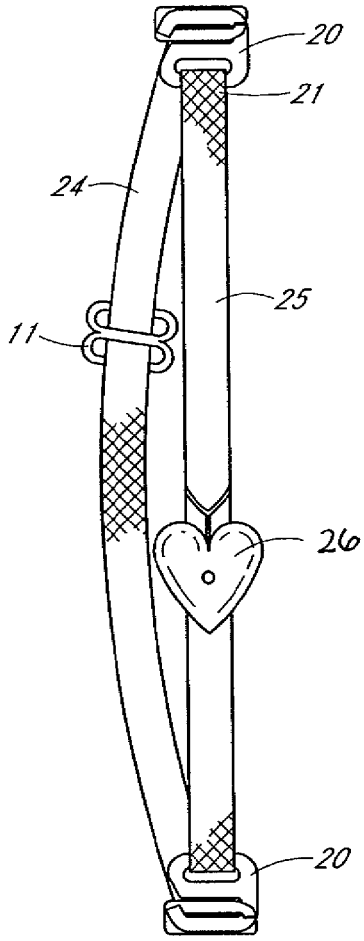

FIG. 1B shows a decorative accessory of another preferred embodiment of the present invention. As shown in FIG. 1B, the accessory comprises a beaded double-strapped elongate body 13 where the straps are secured to the attaching means 10 at the first 15 and second 16 ends of the straps. Additionally, FIG. 1C illustrates a decorative accessory comprising a first strap 24 and a second strap 25 secured to one another by the use of attaching means 20-21 positioned at the ends of the straps. As FIG. 1C illustrates, multiple straps can connect to other straps at a plurality of locations. These locations can include connections at the first and second end of a strap or at a position along the distance between the first and second end of the strap 25. Straps may also attach to other straps by an attaching means such as, for example, a clasp, fastener, or circle connector. Some embodiments, as further illustrated by FIG. 1C, further comprise decorative components 26 secured to one or more of the straps, a length adjustment means 11, and S-shape fasteners 20-21 securing the two straps 24-25 together. Preferably, the decorative components are interchangeable, removable, and replaceable.

Figure 1D:
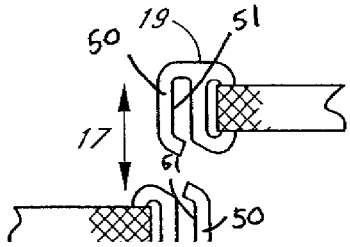
FIG. 1D is a schematic illustration of attachment means for the decorative accessory in accordance with one embodiment of the present invention.

FIGS. 1A-1D additionally show that the attaching means can include, for example, insertion loops, "S" shape fasteners, hinge fasteners, hook and loop clasps, barrel clasps, spring clasps, lobster clasps, magnetic clasps, toggle clasps, box clasps, hook and pile material (such as that sold under the trademark "VELCRO"), and/or rings. As shown in FIG. 1D, the attaching means can comprise detachable mating components 17 such that each first attaching means 18 can attach to any second attaching means 19 provided that the two have corresponding mating components. Additionally, in some embodiments, the attaching means positioned at the first end 15 of an elongate strap attaches to the attaching means positioned at the second end 16 of the same elongate strap to form an enclosed circular decorative accessory. As shown in FIG. 1C, in further embodiments, the attaching means 20 on a first strap attaches to the attaching means 21 of a second strap such that both straps are connected. In certain preferred implementations as shown in FIG. 1D, the attaching means generally comprises a hook 50 having an elongate coupling surface 51 adapted to engage with an attachment loop typically present on most conventional bras. Preferably, the hook 50 is sufficiently wide so that it can extend through the attachment loop present on the bra. Preferably, the coupling surface 51 on the attachment means is substantially linear and extends in a direction that is substantially perpendicular from the longitudinal axis of the elongate strap.

Figure 2:
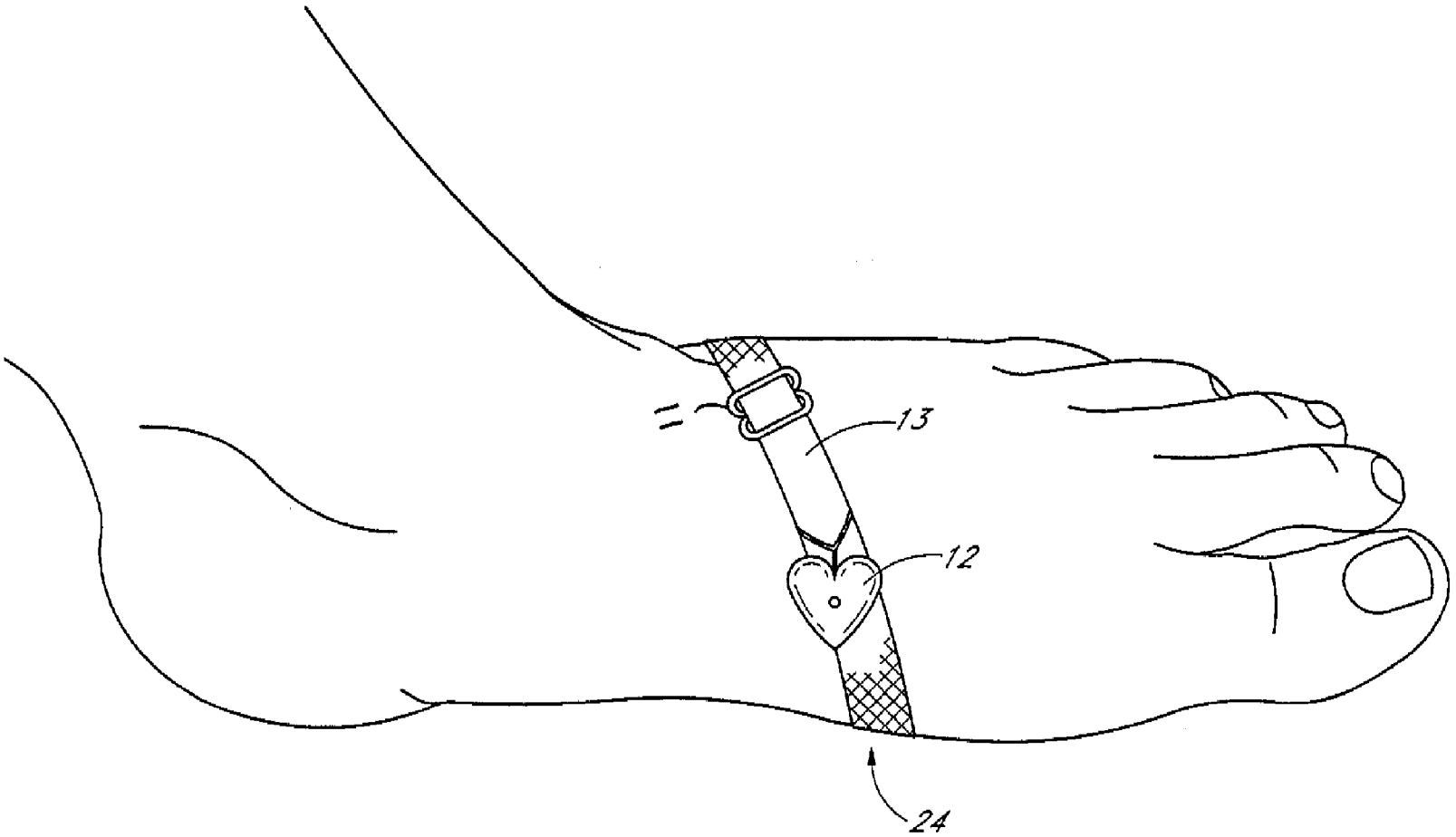
FIG. 2 illustrates the manner in which the interchangeable accessory of FIG. 1A can be worn on a person's foot.

FIG. 2 shows the manner in which the accessory as disclosed in FIG. 1A may be worn on a person's foot. As shown in FIG. 2, the strap 13 is wrapped around the foot in a manner such that the strap extends annularly around the arch area of the foot. In one embodiment, the decorative accessory adorns a top portion of a wearer's foot by providing for one or more decorative components 12 that rest on the upper surface of the wearer's foot over the arch area. Some further embodiments provide for a bottom strap of minimal thickness to reduce the perception of the bottom strap's presence on the surface of a wearer's foot. Other embodiments provide for straps, adjustment means, and/or attaching means, made of see-through or transparent material. Additionally, in some embodiments, the decorative accessory may be advantageously worn such that the attaching means 20-21 and/or the adjustment means 11 are not visible to the casual, undiscerning eye.

Figure 3:
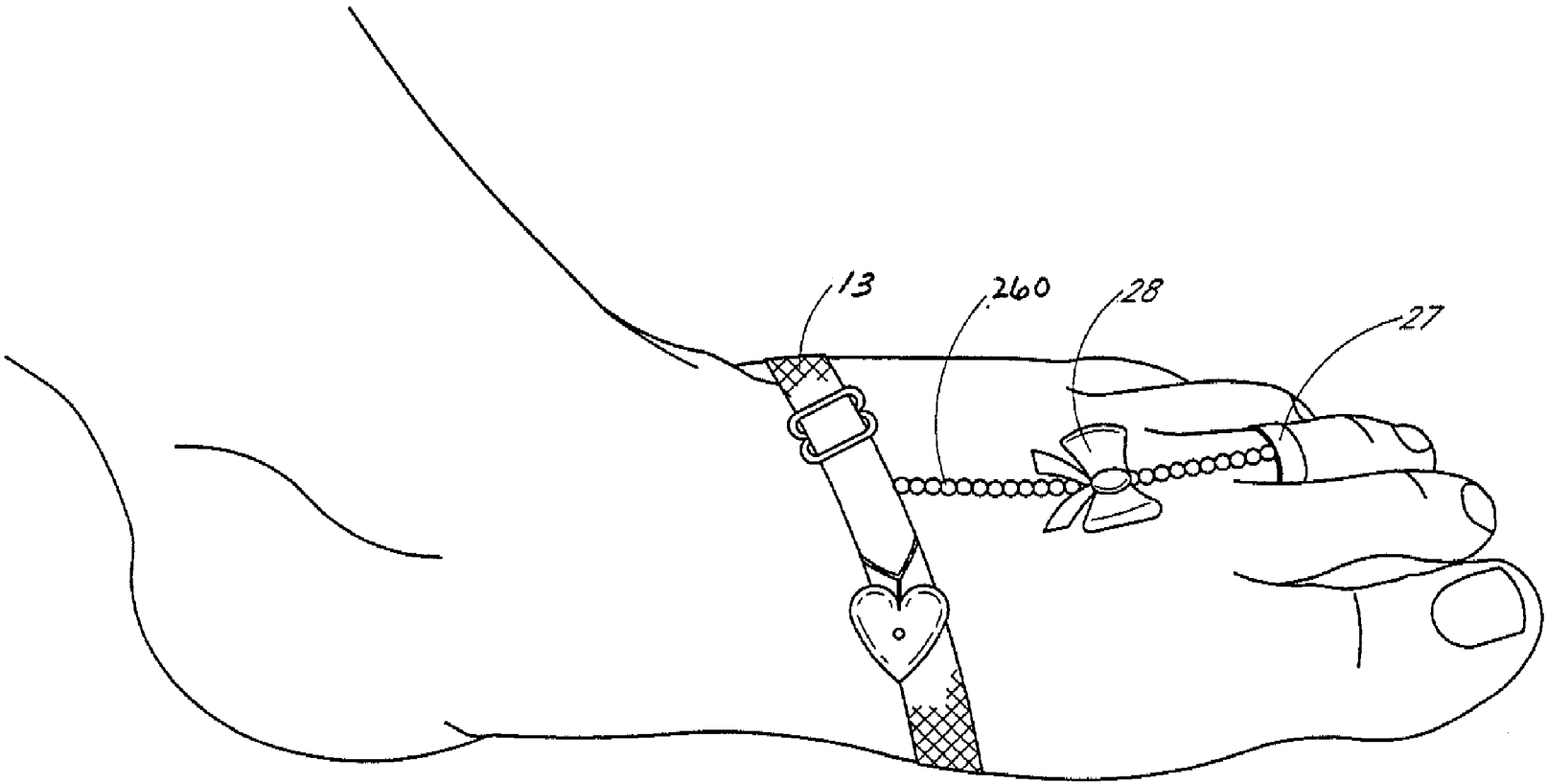
FIG. 3 illustrates the manner in which the interchangeable decorative accessory of FIG. 1A can be worn on a person's foot in combination with other decorative adornments.

As shown in FIG. 3, in addition to the features described above, a decorative accessory according to certain preferred embodiments of the present invention may further comprise at least one additional decorative elongate element 260 connected to the top strap 13, at least one toe attaching means 27, such as a ring, adapted to secure the decorative accessory to a wearer's foot, and at least one attaching means for securing the toe attaching means to the top strap 13. As illustrated in FIG. 3, the toe attaching means may be a toe ring designed to fit over some or all of the wearer's toes. For example, the embodiment of FIG. 3 discloses a toe ring 27 for securing the decorative accessory to the wearer's foot. As further disclosed in FIG. 3, the decorative accessory may further comprise additional decorative components 28 such as those described above.

Figure 4:
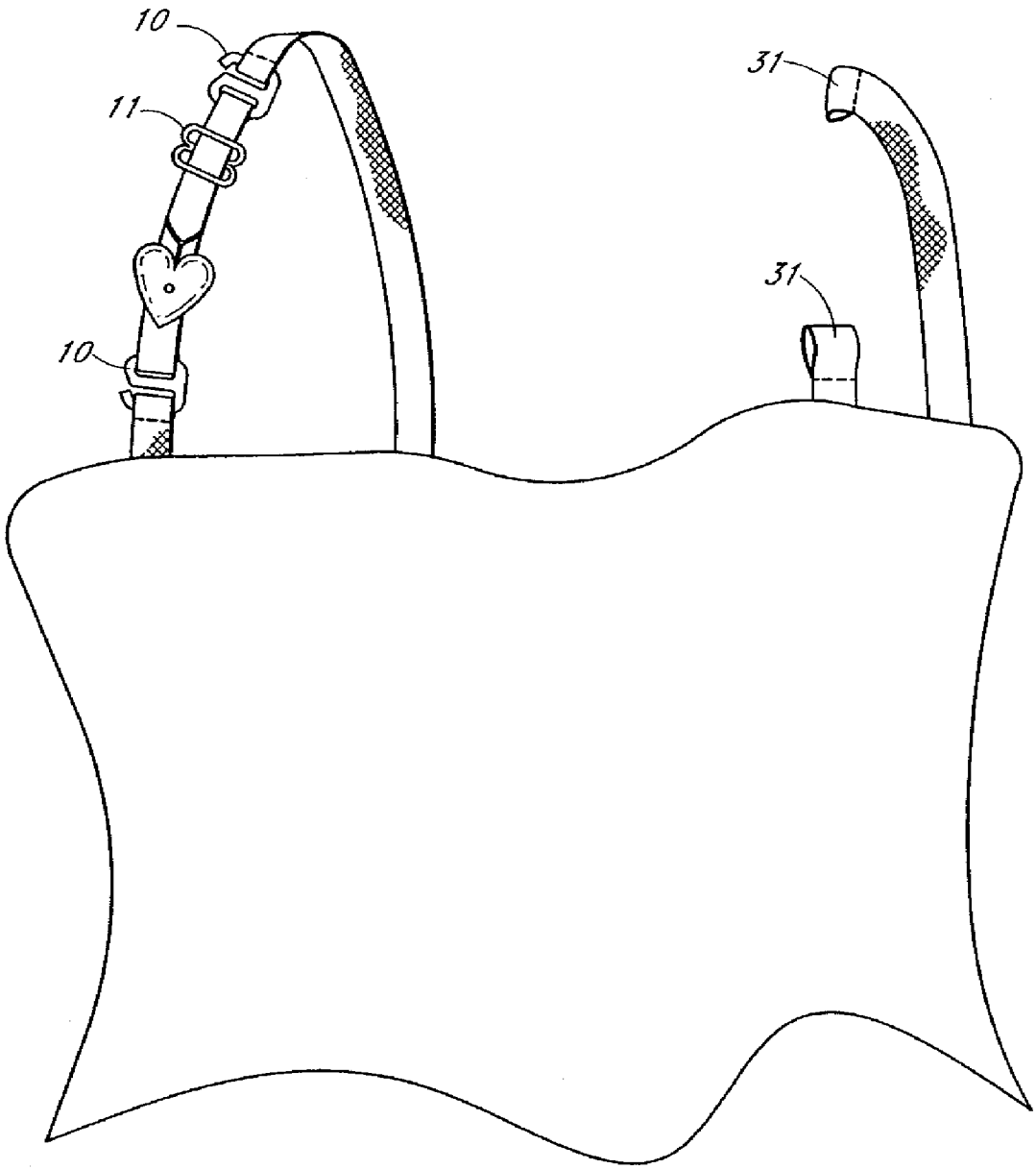
FIG. 4 illustrates the manner in which the interchangeable decorative accessory of FIG. 1A can be secured to a camisole strap.

FIG. 4 illustrates the manner in which the decorative accessory can be interchangeably worn on an article of clothing such as a clothing strap. As shown in FIG. 4, the decorative accessory can be adapted to adorn the straps of a camisole top. Preferably, the article of clothing comprises at least one attaching means such as, for example, an insertion loop or a fastener to secure the accessory onto the clothing. In FIG. 4, the article of clothing comprises insertion loops 31 such that the attaching means 10 of the decorative accessory is sized and configured to connect to the corresponding insertion loops and secure the decorative accessory to the camisole strap. As further shown in FIG. 4, the insertion loops 31 are positioned on the ends of two or more separable segments of an article of clothing such that when the decorative accessory is attached to the insertion loops, the two or more separable segments of clothing are secured together.

Figure 5:
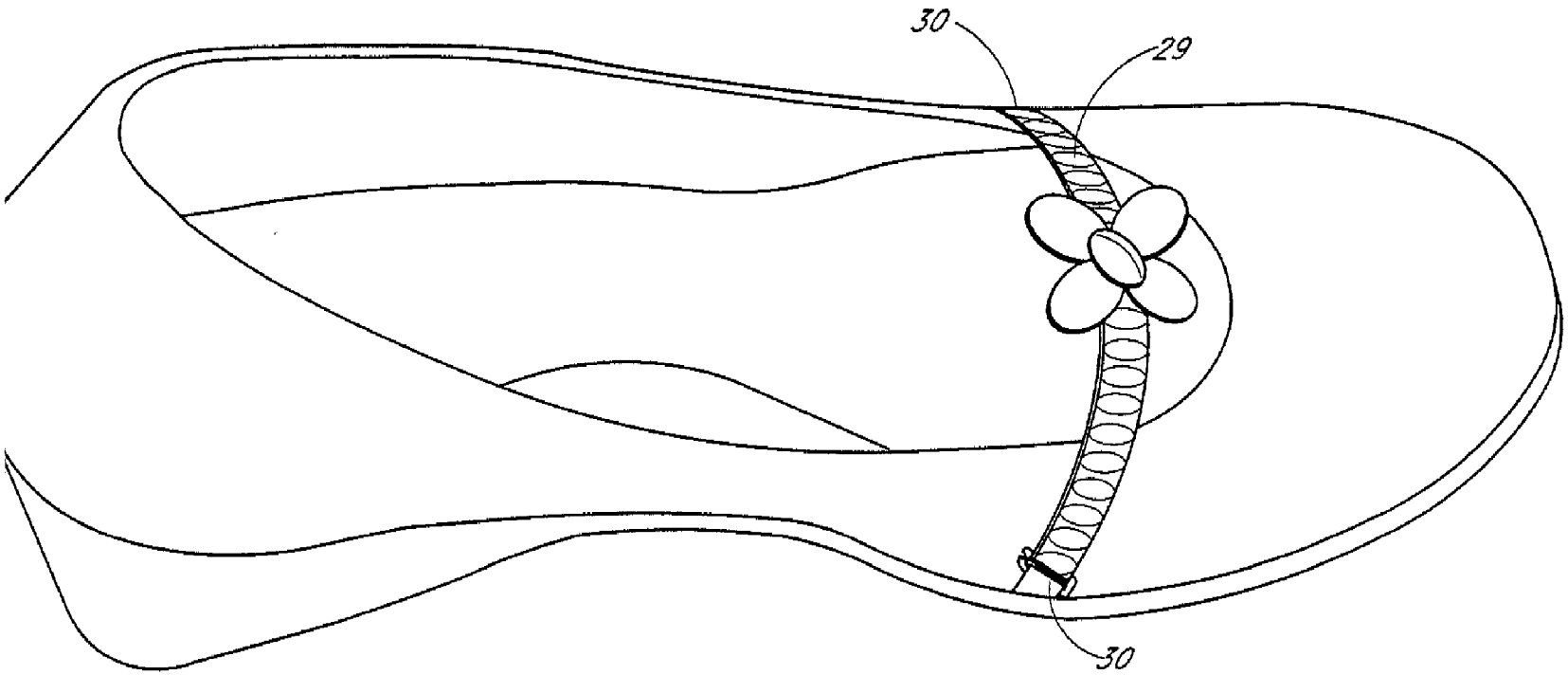
FIG. 5 illustrates the manner in which an interchangeable decorative accessory of another embodiment can be secured to footwear.
Figure 10:
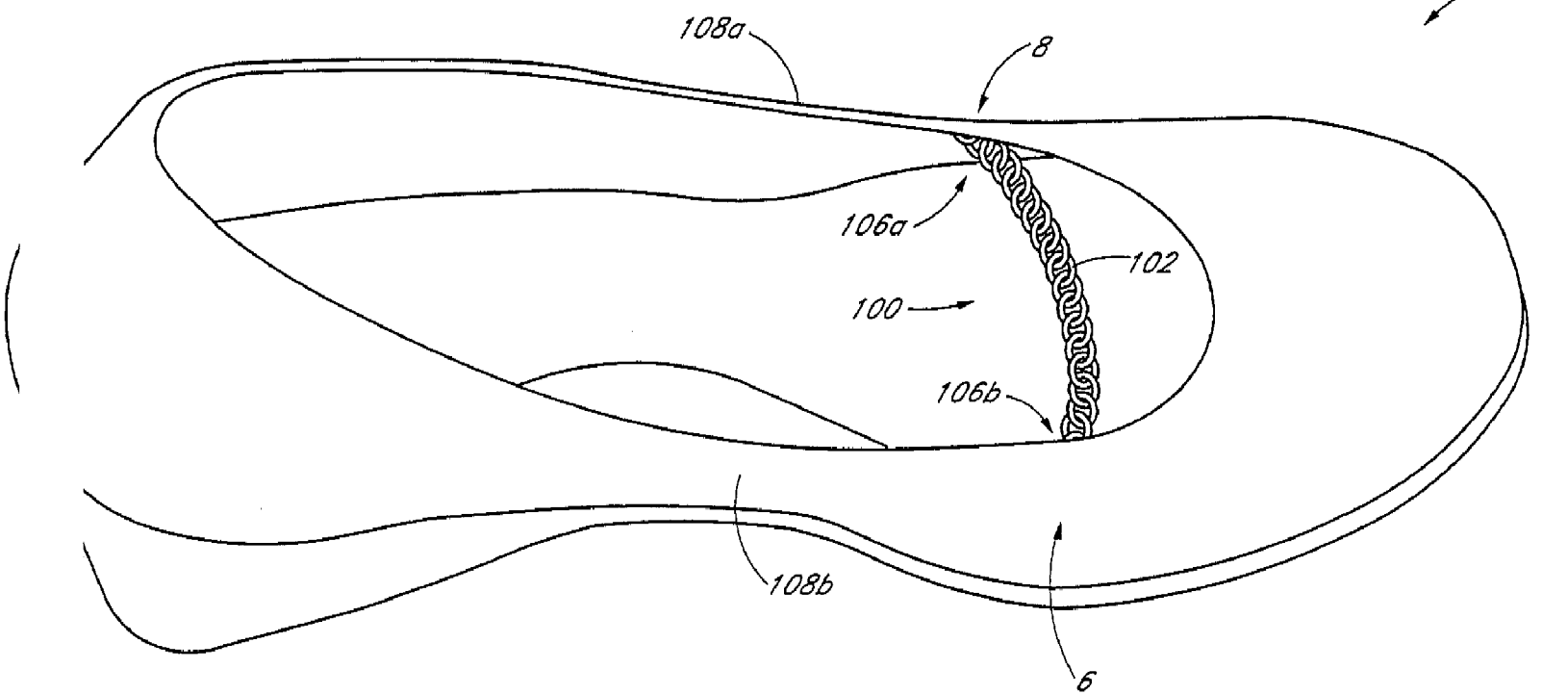
FIG. 10 illustrates yet another embodiment of an interchangeable decorative accessory which can be attached to the inner sidewalls of a shoe.

FIG. 5 illustrates the manner in which a decorative accessory of another embodiment can be interchangeably worn on an article of footwear such as a shoe. As shown in FIG. 5, the decorative accessory is removably attached to an upper portion of a shoe. The strap 29 is secured to the shoe in a manner such that the strap extends along the top portion of the shoe. Additionally, the shoe may comprise receiving areas or attaching means 30 to correspondingly mate with the attaching means positioned on the ends of the elongate strap. For example, the shoe may contain insertion loops 30 whereby the attaching means enter said insertion loops to form a secure connection between the decorative accessory and the shoe. Preferably, the attaching means secure the elongate strap 29 to the article of footwear by insertion into receiving insertion loops located on the target article of footwear 30. In other embodiments, the article of footwear may comprise attaching means that can correspondingly mate with the attaching means located on the decorative accessory of the present invention such that when mated, the decorative accessory is secured to the article of footwear. In one implementation as shown in FIG. 10, the accessory 100 comprises an elastic decorative portion 102 extending between two hooks 104*a*, 104*b* or other attachment means. The hooks 104*a*, 104*b* are preferably adapted to mate with corresponding attachment points 106*a*, 106*b* disposed inside the sidewalls 108*a*, 108*b* of a shoe 110 so that only the decorative portion 102 is exposed. Advantageously, in further embodiments, the decorative accessory comprises a top strap that extends along the top portion of the shoe and the bottom strap that extends along the bottom of the shoe such that the decorative accessory is secured to the shoe.

Figure 6:
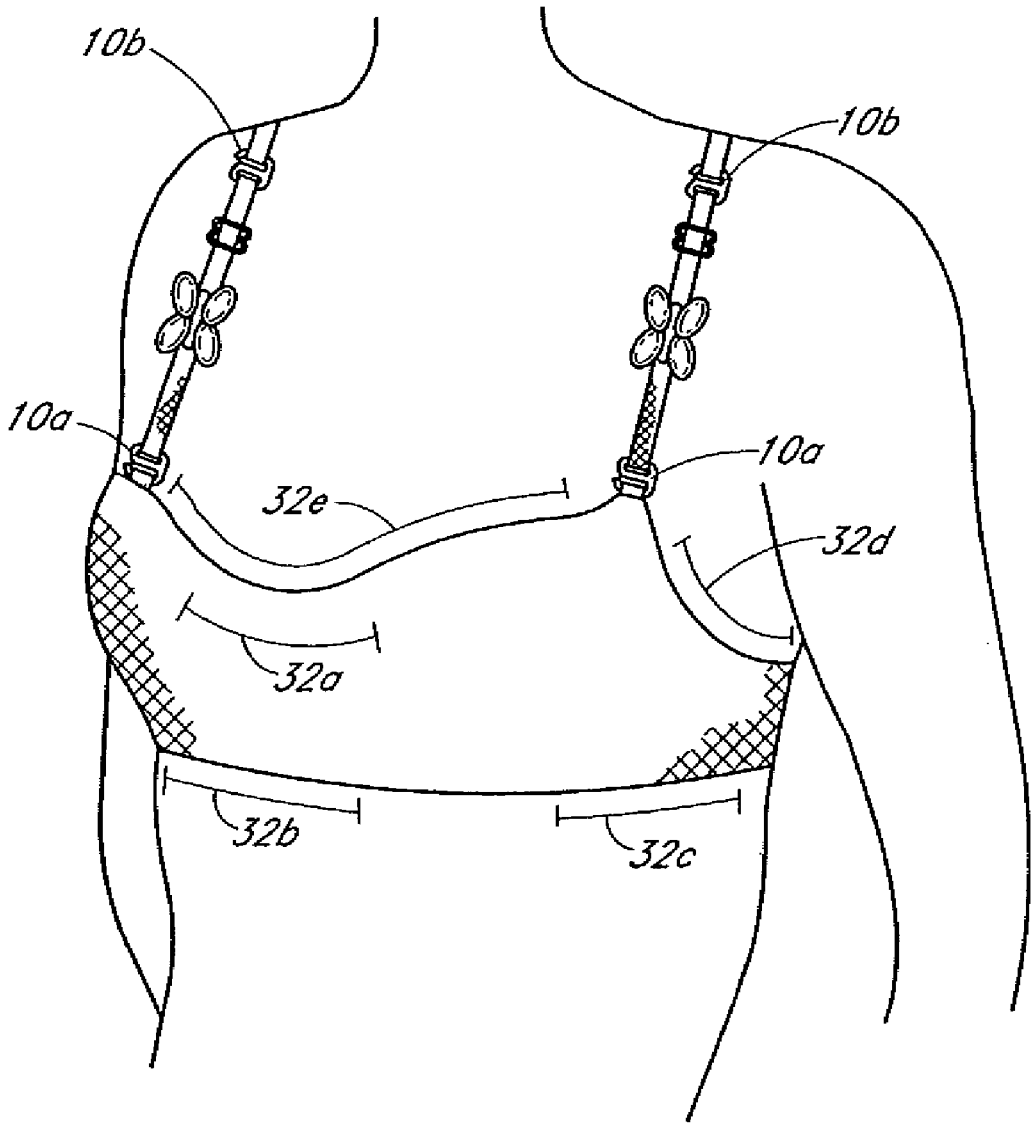
FIG. 6 illustrates the manner in which the interchangeable decorative accessory of FIG. 5 can be secured to a bra.

FIG. 6 illustrates the manner in which the decorative accessory can be interchangeably worn on a bra or bikini. Preferably, the bra or article of clothing comprises at least one attaching means such as, for example, an insertion loop or a fastener to secure the accessory onto the clothing. In FIG. 6, two decorative accessories are secured to the front section of a bra where the attaching means 10*a* are secured to the top portion of the bra-cups and the attaching means 10*b* are secured to insertion loops located on the bra strap. In other embodiments, the decorative accessory may adorn any section on the article of clothing such as the back section of bras or bikinis or other sections on the front portion of clothing 32(*a*)-(e).

Figure 7:
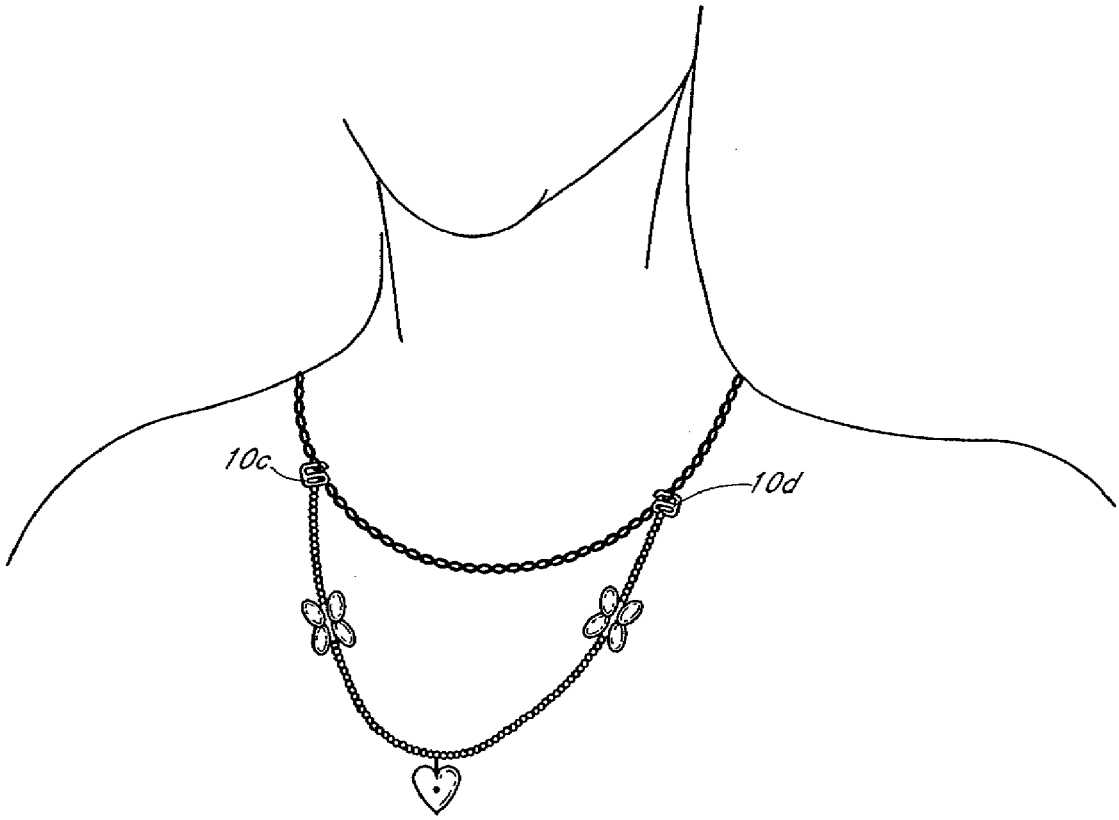
FIG. 7 illustrates the manner in which the interchangeable decorative accessory of one preferred embodiment can be worn as part of a necklace.

FIG. 7 illustrates the manner in which the decorative accessory can be interchangeably worn to adorn another accessory. Preferably, the decorative accessory comprises attaching means suitable for securing the decorative accessory to another accessory such as a necklace, bracelet, and/or anklet. As shown in FIG. 8, the decorative accessory is secured to a necklace by attaching means 10(*c*)-(*d*) with interchangeable attachments.

Figure 8B:
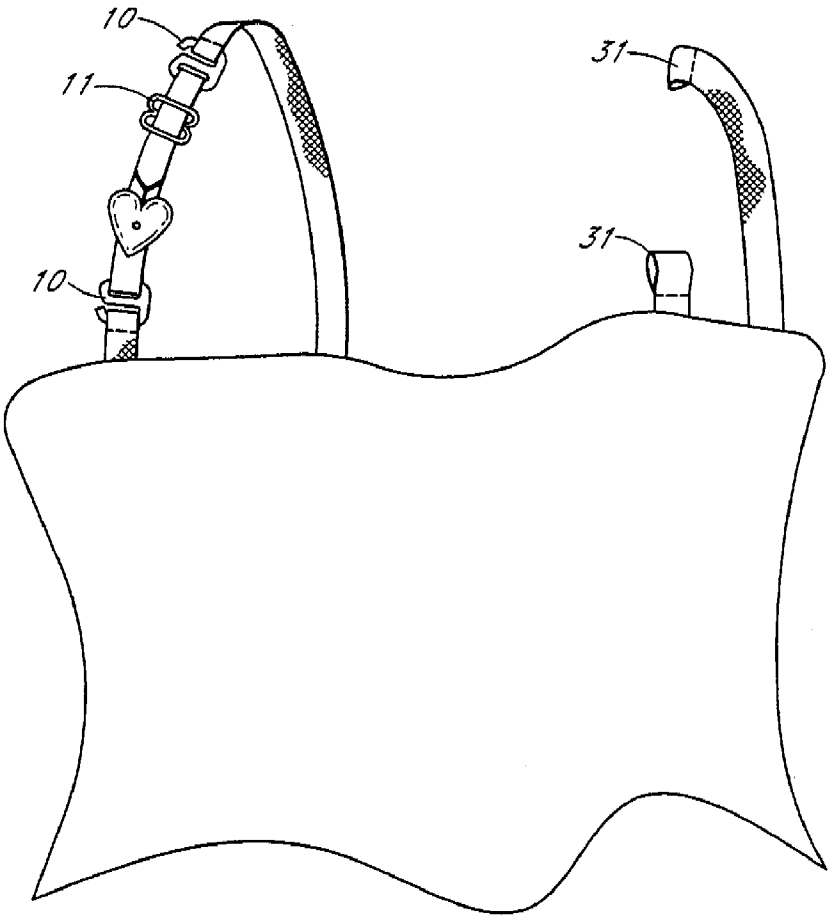
FIGS. 8A, 8B, and 8C illustrate the manner in which the interchangeable decorative accessory of FIG. 1A can be interchangeably worn on a variety of locations on a person's body.
Figure 8A:
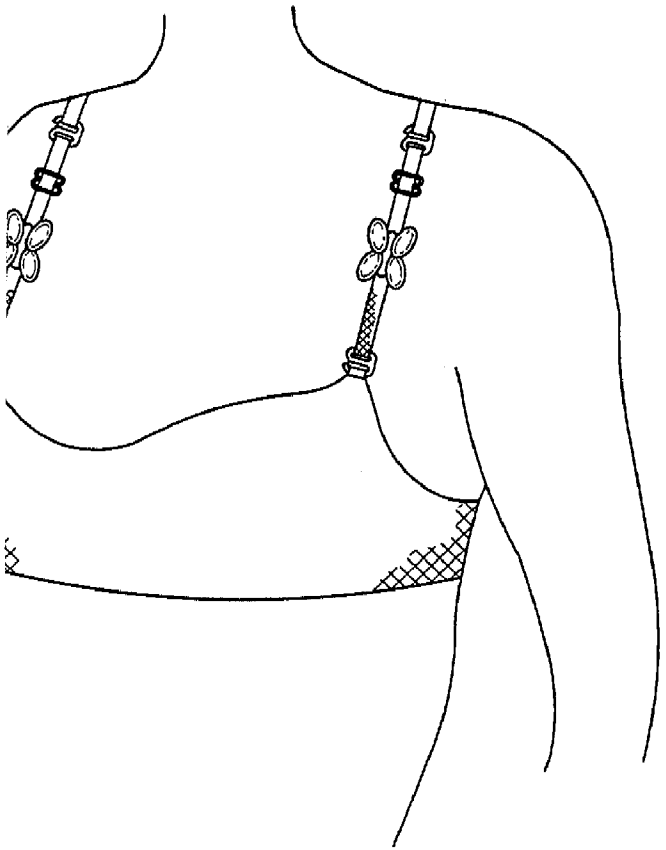
Figure 8C:
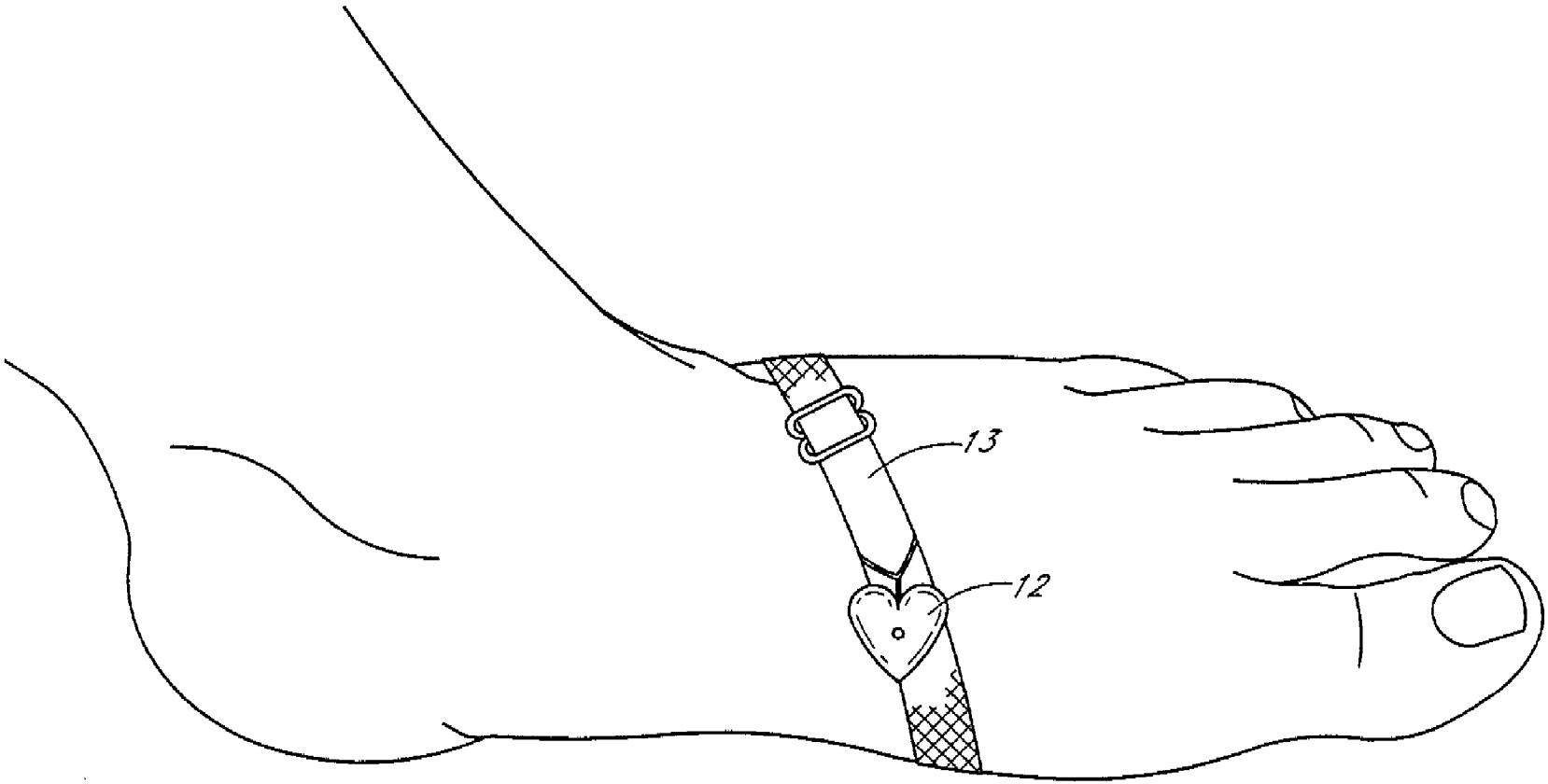
Figure 9:
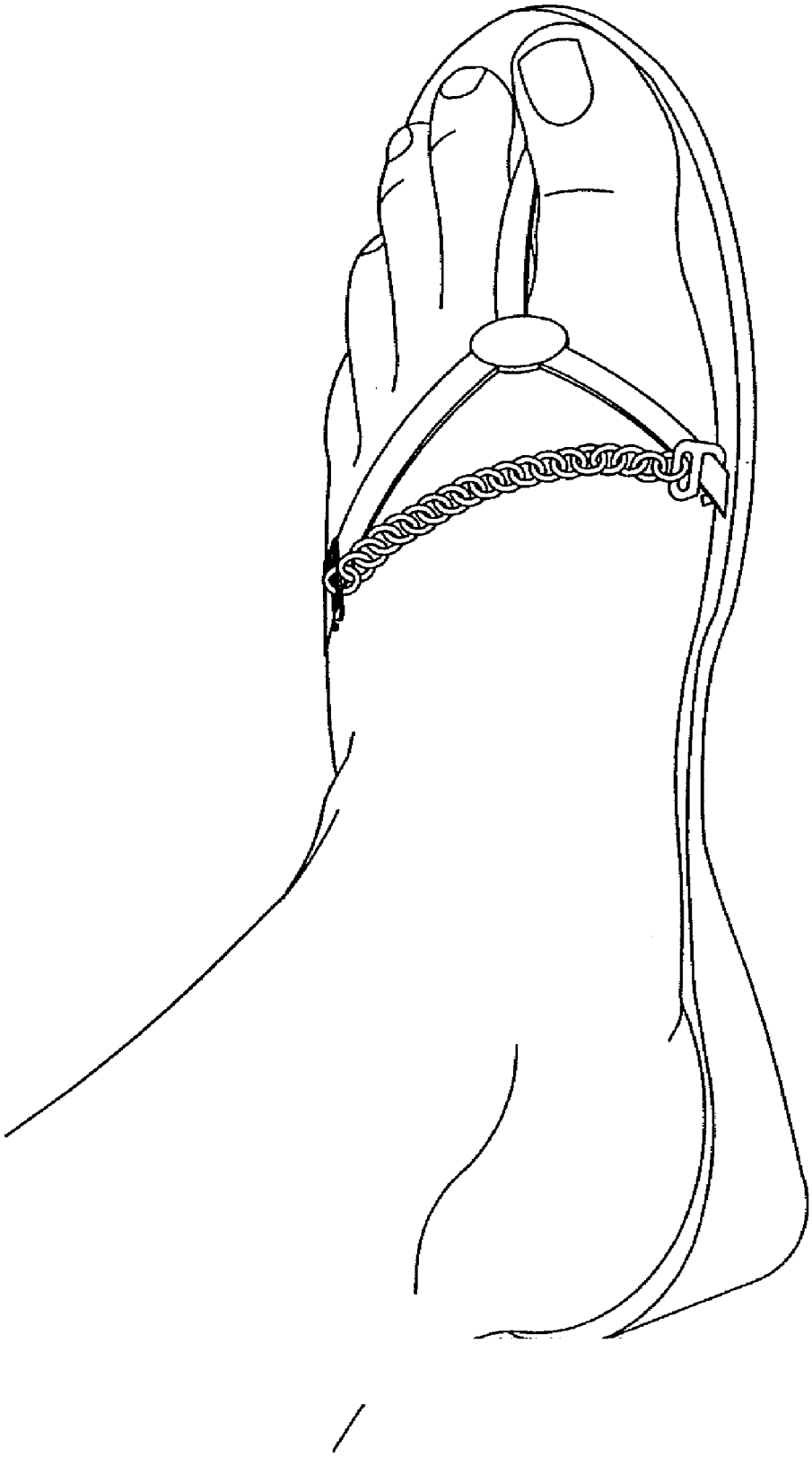
FIG. 9 illustrates another embodiment of an interchangeable decorative accessory which can be attached to sandal straps and extend across the arch portion of a person's foot.

FIGS. 8A-8C illustrate the manner in which the decorative accessory of FIG. 2 can be interchangeably worn on various locations on a wearer's body as well as on articles of clothing. As shown in FIG. 8A, the decorative accessory of FIG. 2 is secured to the bra straps by attaching means 10 as shown and described in FIGS. 1A and 6.

As shown in FIG. 8B, the decorative accessory can be interchangeably worn on a camisole strap. Advantageously, a person may wear the decorative accessory on the bikini or bra strap at one point in time, remove the decorative accessory, and wear the decorative accessory on another article of clothing, such as the camisole strap described in FIG. 8B. Preferably, the individual may decide the placement of the decorative accessory and the number of decorative accessories to use on a variety of articles of clothing, accessories, and locations on the wearer's body.

FIG. 8C illustrates the decorative accessory worn interchangeably on a foot. As illustrated in FIG. 8C, a person may remove the decorative accessory from the bra depicted in FIG. 8A or the camisole strap in FIG. 8B, attach a second elongate strap to extend its length, and secure the decorative accessory to a portion of a wearer's foot. The decorative accessory of FIG. 8C can also be interchangeably removed from the foot and worn on an article of footwear such as a shoe as shown in FIG. 5.

In yet another embodiment, the decorative accessory comprises an elongate chain that is sized to wrap around one or more toes as well as the arch area. Preferably, the chain extends around one or more toes in a manner such that the chain alternates between the front and back of the toe.

Figure 11:
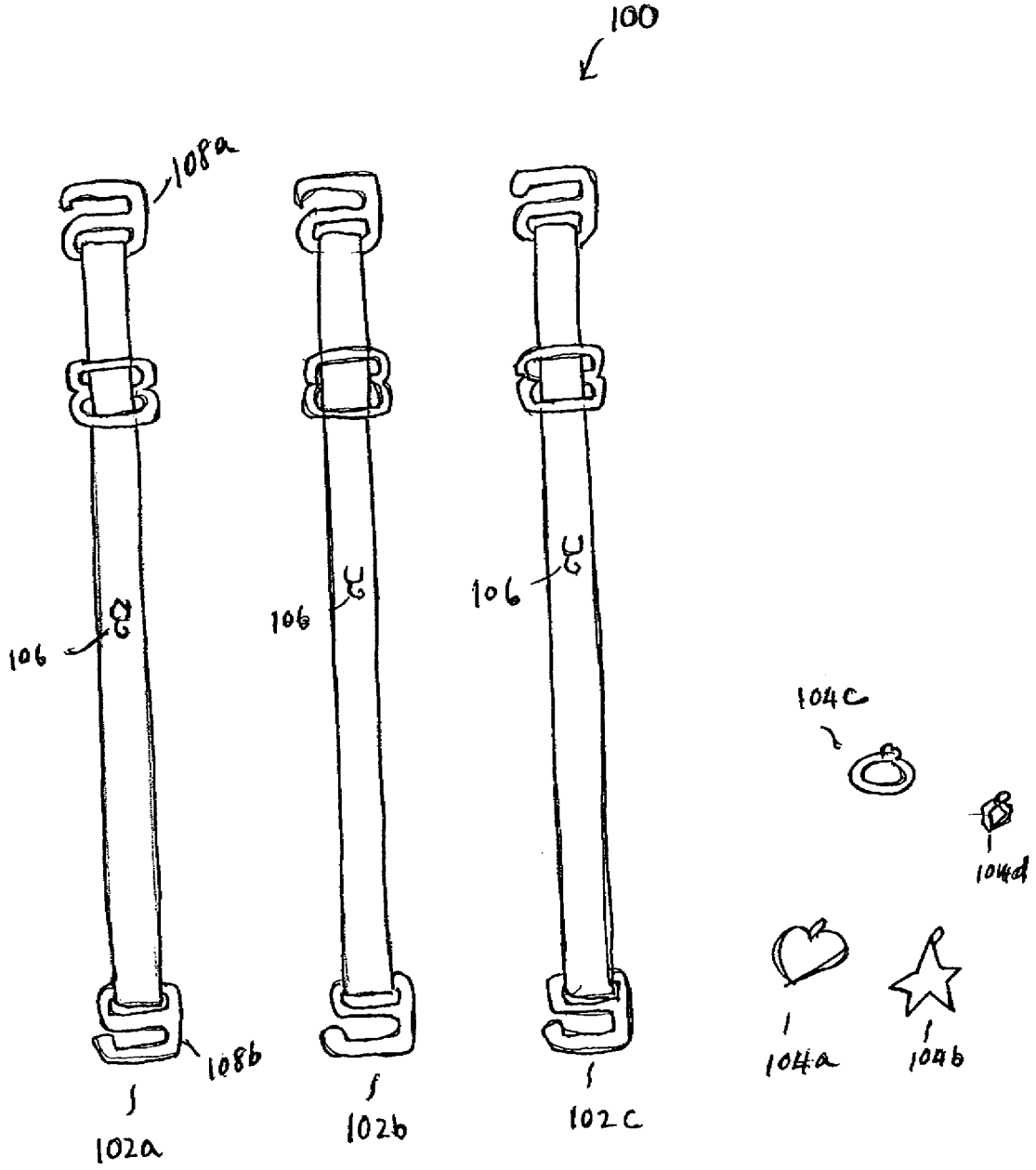
FIG. 11 illustrates yet another embodiment of the present invention showing a decorative accessory kit.

In addition to all the advantages described, the decorative accessory also provides for washable and cleanable embodiments. FIG. 11 illustrates another preferred embodiment of the present invention which comprises a decorative accessory kit 100. The decorative accessory kit 100 comprises a plurality of straps 102 *a-c* and a plurality of decorative adornments 104 *a-d*. Each strap 102 *a-c* has an adornment attachment means 106 disposed on the strap and adapted to attach a decorative adornment to the strap. Each strap 102 *a-c* further includes two fastening means 108 *a-b*, disposed on opposing ends of the strap. The fastening means 108 *a-b* are adapted to fasten each strap around the arch of a person's foot or other body parts. Alternatively, the fastening means 108 *a-b* are also configured to attach the strap to insertion loops on conventional apparel items such as bras and camisoles. In a preferred embodiment, each strap is of a different color and the decorative adornments can be interchangeably attached to each strap. Further, each strap can be interchangeably attached to various parts of the body or articles of clothing.

Advantageously, the decorative accessory as described is designed to conveniently provide interchangeable use of a single accessory. As such, a person is not limited to wearing a particular accessory on a particular location. Rather, the wearer can select from a variety of locations, accessorize accessories and clothing in innumerable ways, and avoid unnecessary expense and accumulation of clutter. Additionally, the decorative accessory is configured to allow different decorative components such as charms or other jewelry to be interchangeably attached to the decorative accessory.

It can be appreciated that the articles of clothing, accessories, and locations on a wearer's body described above are non-exhaustive, non-limiting examples of the present invention. Although described in terms of specific examples, one of skill in the art will recognize that the present invention described herein may adorn many further articles of clothing, accessories, and locations on a body. Additionally, the decorative accessory of certain preferred embodiments of the present invention can also be used in a number of other applications. For example, the decorative accessory can be used to attach a key to an article of clothing, to attach a blanket to a stroller, or a number of other applications.

In one embodiment, the decorative accessory can be used to embellish articles of clothing such as sweaters, blouses, coats, dresses and the like. In one implementation, the decorative accessory can be attached to an article of clothing in a manner such that the accessory hangs vertically on an article of clothing. Alternatively, the decorative accessory can be attached to an article of clothing in a manner such that the accessory hangs horizontally across the neck area. In alternative embodiments, the decorative accessory can be attached to a watch pocket in a manner such that the accessory extends between the watch and the pocket for security and embellishment purposes. In yet another alternative embodiment, the decorative accessory can be used to attach valuable hand-held electronics such as cell phones, iPods, Bluetooth electronics to pocketbooks, briefcases, backpacks for security and embellishment purposes. In yet another alternative embodiment, the decorative accessory can be used to attach pairs of cuffs, mittens and gloves together. In yet another alternative embodiment, the decorative accessory can be used as an adornment embellishment and identification item for valuable items, such as one's favorite liquor bottle or wedding gifts. The decorative accessory can also be used by teenagers to place his or her bedroom door, bicycle, or other personal items with a locking system attached. Additional applications of the decorative accessory of the preferred embodiments include its use as an attachment to a wedding head piece, woven hair accessory, earrings, belly art, bracelet as medical ID. The decorative accessory can also be used to embellish coats in a variety of ways, such as collar to collar, button hole to button hole, or simply hanging down vertically.

Although the foregoing description of the invention has shown, described and pointed out novel features of the invention, it will be understood that various omissions, substitutions, and changes in the form of the detail of the apparatus as illustrated, as well as the uses thereof, may be made by those skilled in the art without departing from the spirit of the present invention. Consequently the scope of the invention should not be limited to the foregoing discussion but should be defined by the claims to be appended upon filing a non-provisional application.

What is claimed is:

1. An interchangeable, decorative accessory kit comprising:

a footwear item, said footwear item having at least one attachment point;

an apparel item, said apparel item is configured for a person's upper torso, wherein the apparel item comprises at least one attachment loop;

an elongate member having a first end and a second end, wherein the elongate member is sized to extend annularly around the arch area of a person's foot, wherein the elongate member is attachable to the at least one attachment point on the footwear item and to the at least one insertion loop on the apparel item;

an adornment attachment member, wherein said adornment attachment member is attached to the elongate member and extends outwardly from a surface of the elongate member;

a plurality of fastening members, wherein one fastening member is disposed on the first end and another fastening member is disposed on the second end of the elongate member, wherein said fastening members are adapted to mate with the at least one attachment loop on the apparel item;

an adornment member, wherein the adornment member is attached to the elongate member via the adornment attachment member in a manner such that when the elongate member is attached to the at least one attachment point on the footwear item and extends annularly around the arch area of the person's foot, the adornment member rests against at least a portion of the top of the person's foot.

2. The interchangeable, decorative accessory kit of claim 1, wherein the elongate member is made of an elastic material.

3. The interchangeable, decorative accessory kit of claim 1, wherein each fastening member comprises a hook that is sized and configured to engage with an insertion loop on a bra.

4. The interchangeable, decorative accessory kit of claim 1, wherein the elongate member is made of a fabric material that can be laundered.

5. The interchangeable, decorative accessory kit of claim 1, wherein the adornment attachment member is selected from the group consisting of jump rings, clasps, hooks, "S" shape fasteners, hinge fasteners, hook and loop clasps, barrel clasps, spring clasps, lobster clasps, magnetic clasps, toggle clasps, box clasps, hook and pile material, and rings.

6. The interchangeable, decorative accessory kit of claim 1, wherein the accessory can be interchangeably worn as a foot jewelry and as a decorative bra strap.

7. The interchangeable, decorative accessory kit of claim 1, wherein the elongate member is substantially transparent.

8. The interchangeable, decorative accessory kit of claim 1, wherein the elongate member comprises a precious metal.

9. A method of interchangeably wearing a decorative accessory on an article of clothing for a person's upper torso and on a footwear, comprising:

providing an article of clothing for a person's upper torso, said article of clothing having at least one insertion loop;

providing at least one footwear item, said footwear having at least one attachment loop;

providing a decorative elongate member having an adornment, said decorative elongate member having attachment members disposed thereon;

fastening the decorative elongate member around the arch area of the person's foot by interconnecting the decorative elongate member to the attachment loop on the footwear and connecting the attachment members in a manner such that the adornment rests against a top portion of the person's foot when the person's foot is inserted into the footwear;

removing the decorative elongate member from the arch area of the person's foot and from the attachment loop on the footwear; and attaching the decorative elongate member to the article of clothing by inserting at least one of the attachment members through the at least one insertion loop.

* * * * *